US006534114B2

(12) United States Patent
Bermel et al.

(10) Patent No.: US 6,534,114 B2
(45) Date of Patent: Mar. 18, 2003

(54) COATING METHOD FOR MODIFYING ADHESION OF THIN FILMS TO SUBSTRATES

(75) Inventors: Marcus S. Bermel, Pittsford, NY (US); Charles L. Bauer, Webster, NY (US); Steven P. McKeown, Rochester, NY (US); Kenneth J. Ruschak, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/796,153

(22) Filed: Feb. 28, 2001

(65) Prior Publication Data

US 2002/0160120 A1 Oct. 31, 2002

(51) Int. Cl.[7] ..... B05D 1/34

(52) U.S. Cl. ..... 427/8; 427/358; 427/402; 427/420

(58) Field of Search ..... 427/402, 420, 427/358, 8; 118/411, DIG. 4

(56) References Cited

U.S. PATENT DOCUMENTS

| | | | | |
|---|---|---|---|---|
| 2,761,791 A | | 9/1956 | Russell | |
| 3,376,208 A | | 4/1968 | Wood | |
| 3,411,908 A | * | 11/1968 | Crawford et al. | 96/74 |
| 3,531,314 A | * | 9/1970 | Kerr et al. | 117/34 |
| 3,755,683 A | | 8/1973 | Kiikka et al. | |
| 4,128,426 A | | 12/1978 | Ohta et al. | |
| 4,594,262 A | | 6/1986 | Kreil et al. | |
| 4,689,359 A | | 8/1987 | Ponticello et al. | |
| 4,748,150 A | | 5/1988 | Vanier et al. | |
| 5,232,825 A | | 8/1993 | Hattori et al. | |
| 5,425,980 A | | 6/1995 | Grace et al. | |
| 5,458,925 A | * | 10/1995 | Hirshburg et al. | 427/402 |
| 5,849,363 A | * | 12/1998 | Yapel et al. | 427/420 |

* cited by examiner

*Primary Examiner*—Katherine A. Bareford
(74) *Attorney, Agent, or Firm*—Mark G. Bocchetti

(57) ABSTRACT

A method is taught for that allows for controlling and optimizing the level of adhesion between a multilayer composite applied to a support web. The method comprises the steps of selecting the support web with or without a subbing layer applied thereto; selecting an organic solvent that is substantially free of other constituents as a carrier layer; forming a multilayer composite including the carrier layer, the carrier layer being the lowermost layer thereof; applying the multilayer composite to the support web or the subbing layer; drying the multilayer composite on the support web, the carrier layer evaporating from the multilayer composite; testing the adhesive strength between the support web or subbing layer and the multilayer composite after drying; and repeating these steps until a desired level of adhesion is found.

24 Claims, 1 Drawing Sheet

COATING METHOD FOR MODIFYING ADHESION OF THIN FILMS TO SUBSTRATES

FIELD OF THE INVENTION

This invention relates generally to methods for coating a moving web and, more particularly, to controlling adhesion levels between the moving web and the coating applied thereto, and most particularly, to controlling adhesion levels between photographic film base web and the multilayer coatings applied thereto.

BACKGROUND OF THE INVENTION

Multilayer coating is well known in the prior art as described, for example, in U.S. Pat. No. 2,761,791 to Russell. In the method typically referred to as slide bead coating, a multilayer composite comprised of superimposed individual liquid layers is delivered to the moving substrate through the use of a coating die. At the end of the coating die, the layers form a continuous liquid bridge or coating bead between the die and the moving substrate. The slide bead coating method is useful for making thin, highly uniform, composite elements suitable for numerous applications, including photographic, thermographic, x-ray, and photoelectric films, among others.

Various methods are known in the prior art to promote adhesion between the support and applied layers. In most cases, an adhesive layer or subbing layer is required on a support prior to application of the functional layers. There are a number of disclosures describing unique chemical compositions suitable for subbing layers. U.S. Pat. No. 4,748,150 to Vanier teaches the use of a vinylidene chloride copolymer as a subbing layer to promote the adhesion of a subsequent layer containing a polycarbonate. Alternatively, a support may be subjected to electrical discharge pretreatments including corona discharge as described in U.S. Pat. No. 3,376,208 to Wood, glow discharge as described in U.S. Pat. No. 5,425,980 to Grace, or electron-beam irradiation U.S. Pat. No. 4,594,262 to Kreil. More commonly, a substrate requires a combination of electrical treatment and the application of a subbing layer to achieve good adhesion such as, for example, described for example in U.S. Pat. No. 4,128,426 to Ohta, U.S. Pat. No. 4,689,359 to Ponicello, and U.S. Pat. No. 5,232,825 to Hattori.

The equipment required for electrical treatment of substrates, such as those described above, is expensive and adds complexity to the manufacturing process. Moreover, such treatments may not be suitable for some coatings when layers are sensitive to chemical alteration of the support by electrical treatment. Similarly, the materials required for an effective subbing layer may be expensive or difficult to identify. There are no known coating methods describing enhancement of adhesion of a functional layer to the support.

Finally, it is sometimes desirable to attenuate the adhesive strength of a functional layer to the support depending on product requirements. In most cases, strong adhesion between applied layers and support is needed. However, some products, such as those designed to delaminate during usage, may require only weak adhesive strength. Continuous modification of the chemistry of the subbing layer to achieve such aims may be expensive and time consuming.

SUMMARY OF THE INVENTION

It is therefore an object of the present invention to provide a method for controlling the level of adhesion between a web and a coating applied thereto.

It is a further object of the present invention to provide a method for applying multilayer coatings to moving webs which allows for modification of adhesion levels between the moving web and the multilayer coating.

Briefly stated, the foregoing and numerous other features, objects and advantages of the present invention will become readily apparent upon a review of the detailed description, claims and drawings set forth herein. These features, objects and advantages are accomplished by selecting the support web with or without a subbing layer applied thereto; selecting an organic solvent that is substantially free of other constituents as a carrier layer; forming a multilayer composite including the carrier layer, the carrier layer being the lowermost layer thereof; applying the multilayer composite to the support web or the subbing layer; drying the multilayer composite on the support web, the carrier layer evaporating from the multilayer composite; testing the adhesive strength between the support web or subbing layer and the multilayer composite after drying; and repeating these steps until a desired level of adhesion is found. The method of the present invention may be practiced in conjunction with slide bead coating apparatus, extrusion hopper coating apparatus, and curtain coating apparatus. In a slide bead coating operation, the multilayer composite flows down the slide surface of the slide bead coating hopper and over a coating lip of the coating hopper to form a coating bead bridging the gap between the lip in the moving web. In this manner, the multilayer composite is applied to the support web or the subbing layer. The carrier layer preferably has a viscosity in the range of 1–10 cp and is applied at a wet thickness in the range of 1–20 $\mu$m; flowing the multilayer composite down the slide surface and over a coating lip of the coating hopper; and forming a coating bead between the coating lip and the web.

In the practice of the method of the present invention, one or more of the upper layers preferably has a viscosity that is greater than the viscosity of the carrier layer. When the carrier layer is formed of a blend of organic solvents, preferably at least two of the following components: methanol, ethanol, isopropanol, n-butanol, acetone, methylethyl ketone, methylisobutyl ketone, toluene and methylene chloride are contained in the blend. It is also preferred that the layers above the carrier layer contain at least one of the following polymeric materials: cellulosics, polyvinylbutyrals, polycarbonates, polyurethanes and polyesters. Further, in the practice of the method of the present invention, it is preferred that the layers above the carrier layer have a combined wet thickness in the range of range of 1–500 $\mu$m and at least one of such upper layers has a viscosity in the range of 10–5,000 cp. In addition, one or more of such upper layers may include water.

As mentioned above, the present invention allows for the control of the level of adhesion between the multilayer composite and the web such that the physical bond therebetween is strong or weak. In particular, the use of the present invention is shown to substantially improve the adhesion of a functional layer to the substrate. Moreover, this advantage is achieved without chemical modification of the support through the use of electrical discharge treatments. Finally, this advantage is achieved without the use of permanent chemical additives in the coated layer. Such additives may be expensive or detrimental to the properties of the final film.

Although the present invention is discussed herein with particular reference to a slide bead coating operation, those skilled in the art will understand that the present invention can be advantageously practiced with other coating operations. For example, the control of the level of adhesion should also be achievable with multilayer extrusion hopper coating operations and multilayer curtain coating operations. In addition, those skilled in the art will recognize that the present invention can be advantageously practiced with carrier layers containing additives such as polymers, surfactants, and etching agents. Practical applications of the present invention include photographic, thermographic and x-ray films as well as photographic, thermographic and inkjet papers, among others.

DETAILED DESCRIPTION OF THE INVENTION

Figure 1:
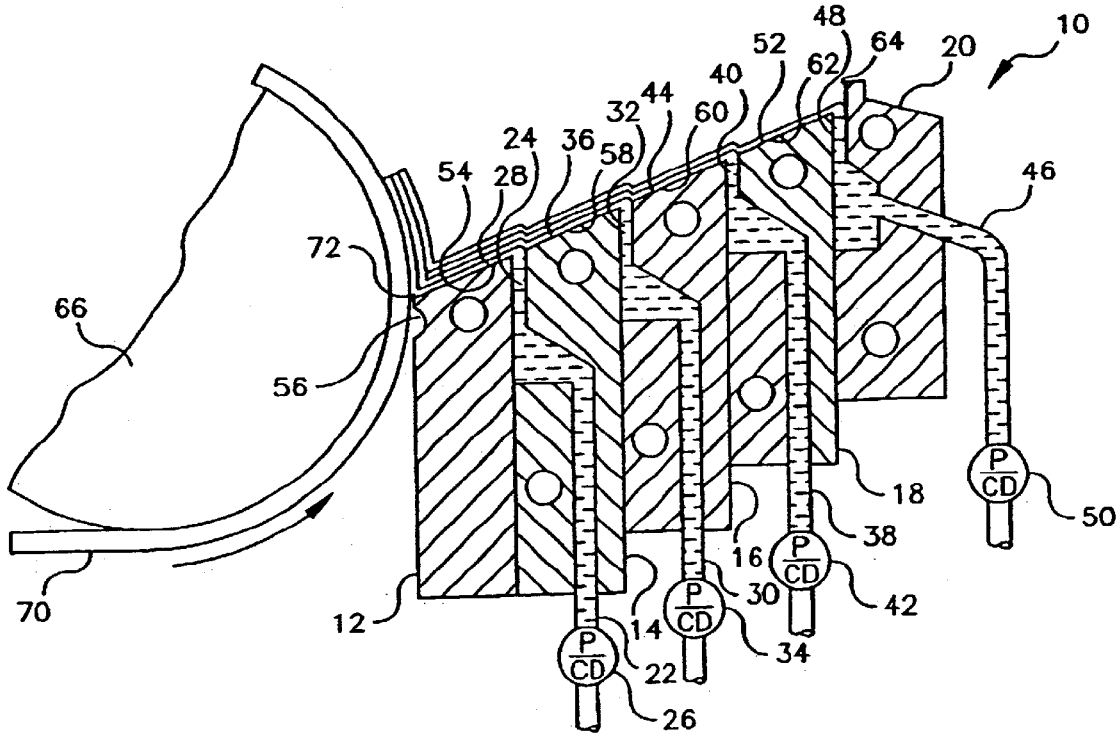
FIG. 1 is a schematic of an exemplary multi-slot slide bead coating apparatus which may be used in the practice of the method of the present invention.

Turning to FIG. 1, there is shown a schematic of an exemplary and well known multi-slot slide bead coating apparatus 10 suitable for practicing the method of the present invention. The multi-slot slide bead coating apparatus 10 is typically used to deliver and coat multiple coating compositions simultaneously as a stacked composite of layers. Coating hopper 10 is shown as having only four slots, but multiple slot hoppers 10 may have fewer than four slots and are also known to deliver a composite layer comprised of five or six (or even more) coating composition layers.

Coating hopper 10, shown in side elevational cross-section, includes a front section 12, a second section 14, a third section 16, a fourth section 18, and a back plate 20. There is an inlet 22 into second section 14 for supplying coating liquid to first metering slot 24 via pump 26 to thereby form a lowermost layer or carrier layer 28. There is an inlet 30 into third section 16 for supplying coating liquid to second metering slot 32 via pump 34 to form layer 36. There is an inlet 38 into fourth section 18 for supplying coating liquid to third metering slot 40 via pump 42 to form layer 44. There is an inlet 46 into back plate 20 for supplying coating liquid to fourth metering slot 48 via pump 50 to form layer 52. Each slot 24, 32, 40, 48 includes a transverse distribution cavity. Front section 12 includes an inclined slide surface 54, and a coating lip 56. There is a second inclined slide surface 58 at the top of second section 14. There is a third inclined slide surface 60 at the top of third section 16. There is a fourth inclined slide surface 62 at the top of fourth section 18. Back plate 20 extends above inclined slide surface 62 to form a back land surface 64.

Residing adjacent the hopper 10 is a coating backing roller 66 about which a web 70 is conveyed. Typically, the hopper 10 is movable from a non-coating position toward the coating backing roller 66 and into a coating position.

In the practice of the method of the present invention, the lowermost or carrier layer 28 is an organic solvent or blend of organic solvents that is substantially free of other constituents. The term "substantially free of other constituents" as used herein is intended to mean that the organic solvent or blend of organic solvents have a purity level of at least 98% and that any contaminants or additives present do not affect the viscosity of the carrier layer 28. This lowermost layer or carrier layer 28 which is metered through the first metering slot 24, moves down the first slide surface 54, and wets the moving web 70 at the point where the coating bead 72 contacts the web 70. In a preferred embodiment of the present invention, the lowermost layer 28 is an organic solvent or blend of organic solvents having a viscosity of less than 10 cp., a surface tension of less than 40 dynes/cm, and a wet thickness range of from about 1 to about 20 $\mu$m on the moving web 70.

As mentioned above, the lowermost layer 28 may be comprised of a single organic solvent. Examples of suitable organic solvents at 20° C. include methanol (0.6 cp.), acetone (0.3 cp.), methylethyl ketone (0.4 cp.), methyl isobutyl ketone (0.6 cp.), methylene chloride (0.4 cp.), toluene (0.6 cp.), methyl acetate (0.4 cp.), ethyl acetate (0.5 cp.), isopropyl acetate (0.5 cp.), n-propyl acetate (0.6 cp.), ethanol (1.2 cp.), n-propanol (2.3 cp.) and n-butanol (3.0 cp.).

Alternatively, the lowermost layer 28 may be comprised of a combination of two or more organic solvents. Examples of suitable organic solvent blends at 20° C. include 1.1 methanol:methylene chloride (0.6 cp.), 1:1 acetone:methanol (0.4 cp.), 1:1:1 acetone:methanol:methylene chloride (0.5 cp.), 1:1 acetone:n-propanol (0.6 cp.), 1:1 acetone:ethanol (0.5 cp.), 1:1 methanol:ethanol (0.7 cp.), 1:1 methylene chloride:ethanol (0.8 cp.), 1:1:1 acetone:methylene chloride:ethanol (0.5 cp.), 1:1:1 methanol:methlylene chloride:n-butanol (0.8 cp.), 1:1:1 acetone:ethanol:n-butanol (0.8 cp.), 1:1:1 methanol:methylene chloride:ethanol (0.8 cp.), and 1:1:1:1 acetone:methanol:methylene chloride:n-propanol (0.6 cp.). For these examples, solvent ratios are by weight.

The second liquid layer 36 which is metered through a second metering slot 32, moves down the second slide surface 58, and is accelerated by the carrier layer 28 down the first slide surface 54 to the coating bead 72. The second layer 36 must be miscible with lowermost layer 28 and is therefore preferably organic, but may contain water. As noted by layers 44, 52 in FIG. 1, additional upper layers may also be applied using the slide bead coating apparatus 10. These additional upper layers may be of a distinct composition relative to the second layer 36 or of the same composition. Similarly, the number of upper layers may also be further increased beyond three by extension of the number of die slots (not shown explicitly in FIG. 1). In a preferred embodiment of the present invention, the upper layers have a combined wet thickness in the range of from about 1 to about 500 $\mu$m, and at least one of the upper layers has a viscosity greater than 10 cp.

Because the method of the present invention may involve application of highly volatile organic solvents, the temperature at which coating is performed is preferably less than or equal to 25° C. to avoid non-uniformities due to streaks and mottle. Methylene chloride, acetone, methyl acetate and methanol are examples of highly volatile organic solvents having a vapor pressure above 100 mm Hg at 25° C.

The method of the present invention is suitable for application of multilayer coatings to a variety of substrates such as polyethylene terephthalate (PET), cellulose acetate (CA), polycarbonate, polystyrene, and other polymeric films. Additional substrates may include paper, laminates of paper and polymeric films, glass, cloth, aluminum and other metal supports. In some cases, substrates may be pretreated with subbing layers or electrical discharge devices. Substrates may also be pretreated with functional layers containing various binders and addenda.

The advantages of the present invention are demonstrated by the following practical examples given below.

EXAMPLE 1

The apparatus 10 illustrated in FIG. 1, was used to apply three organic layers to a moving substrate 70 of untreated polyethylene terephthalate (PET). All coating fluids were comprised of a polyvinylburyral (hydroxyl content of 12%) dissolved in 1:1 methanol:ethanol. The lowermost layer 28 was a variety of organic solvents having a wet thickness in the range of 2.5–7.5 $\mu$M. The organic solvents used as carrier layer 28 in this Example included ethanol, methylethyl ketone, and methylene chloride. The second and third layers each had a viscosity of 600 cp. and a combined final wet thickness of 30 $\mu$m on the moving web 70. Coatings were applied at a temperature of 23.9° C. The gap between the coating lip 56 and the moving web 70 was 200 $\mu$m. The pressure differential across the coating bead 72 was adjusted between 0–10 cm of water to establish a uniform coating. For Example 1, the substrate was untreated polyethylene terephthalate (PET). Coatings were made at substrate speeds of 100 cm/s without defects resulting from entrained air or streaks. Finished samples were analyzed for adhesive strength. Results are summarized in Table 1. As shown in Table 1, adhesive strength is greater on untreated PET when films were prepared with methylene chloride or methylethyl ketone as the carrier layer. In some cases, adhesive strength was more than doubled. For example, the adhesive strength of the polyvinylbutyral layer increased from 2 to 5 N/m on an untreated PET support having no subbing layer when the organic solvent used in the lowermost layer 28 was changed from ethanol to methylene chloride.

EXAMPLE 2

The conditions were identical to those described in Example 1, except that the PET substrate was modified by various subbing layers. In Example 2, PET was precoated with a subbing layer of either cellulose acetate butyrate (CAB) having 38% butryl content or nitrocellulose having 12% nitrogen as noted in Table 1. A coating of polyvinylbutyral was subsequently coated on to the modified PET, dried and tested for adhesive strength as described in Example 1 above. The results are summarized in Table 1. As shown in Table 1, adhesive strength was greater on PET supports having a subbing layer of CAB when films are prepared using methylene chloride or methylethyl ketone as the carrier layer. In some cases, adhesive strength was improved by more than ten fold. For example, the adhesive strength increased from 10 to 160 N/m on a PET support having a subbing layer of CAB when the organic solvent used in the lowermost layer was changed from ethanol to methylene chloride.

EXAMPLE 3

The conditions were identical to those described in Example 1, except that the substrate is changed to untreated cellulose acetate (CA). A coating of polyvinylbutyral was coated on to the cellulose acetate substrate, dried and tested for adhesive strength as described in Example 1 above. The results are summarized in Table 1. As shown in Table 1, adhesive strength was greater on cellulose acetate supports when films were prepared using methylene chloride or methylethyl ketone as the carrier layer. In some cases, adhesive strength was improved by more than ten fold. For example, the adhesive strength increases from 9 to 160 N/m on a cellulose acetate support when the organic solvent used in the lowermost layer was changed form ethanol to methylene chloride.

TABLE 1

| Carrier Solvent | Support | Sub Layer | Polymer Compatibility | Adhesive Strength |
|---|---|---|---|---|
| Ethanol | PET | None | No | 2 N/m |
| Methylethyl ketone | PET | None | No | 3 |
| Methylene chloride | PET | None | No | 5 |
| Ethanol | PET | CAB | Partially | 10 |
| Methylethyl ketone | PET | CAB | Partially | 68 |
| Methylene chloride | PET | CAB | Partially | 160 |
| Ethanol | PET | Nitro-cellulose | Yes | unable to peel* |
| Methylethyl ketone | PET | Nitro-cellulose | Yes | unable to peel |
| Methylene chloride | PET | Nitro-cellulose | Yes | unable to peel |
| Ethanol | CA | None | Partially | 9 |
| 1:1 Methanol:ethanol | CA | None | Partially | 13 |
| Methylethyl ketone | CA | None | Partially | 29 |
| Methylene chloride | CA | None | Partially | 160 |

*Samples prepared with nitrocellulose had very good adhesion and a quantitative measure of adhesive strength was not attained because peeling could not be initiated.

For the data presented in Table 1, multilayer coatings of polyvinylbutyral were applied to various supports using organic solvents as the carrier layer with the slide bead die illustrated in FIG. 1. Final film samples were tested for adhesion by measuring the force required to peel the polyvinylbutyral layers from the support. Results are given in Newtons per meter (N/m). Results are for conditions described in Example 1.

The following test was used to determine the level of adhesion data presented in Table 1. The adhesion strength of the coated samples was measured using a modified 180° peel test with an Instron 1122 Tensile Tester with a 500 gram load cell. First, 0.0254 m (one inch) wide strips of the coated sample were prepared. Delamination of the coating at one end was initiated using a piece of 3M 810 Magic Tape. An additional piece of tape was then attached to the delaminated part of the coating and served as the gripping point for testing. The extending tape was long enough to extend beyond the support such that the Instron grips did not interfere with the testing. The sample was then mounted into the Instron 1122 Tensile Tester with the substrate clamped in the upper grip and the coating/tape assembly clamped in the bottom grip. The average force (in units of Newtons) required to peel the coating off the substrate at a 180° angle at a speed of 2 inches/min (50.8 mm/min) was recorded. Using this force value the adhesive strength in units of N/m was calculated using the equation:

$$S_A = F_p(1-\cos\theta)/w$$

wherein $S_A$ is the adhesive strength, $F_p$ is the peel force, $\theta$ is the angle of peel (180°), and w is the width of the sample (0.0254 m).

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

PARTS LIST:

| | |
|---|---|
| 10 | multi-slot slide bead coating apparatus/hopper |
| 12 | front section |
| 14 | second section |
| 16 | third section |
| 18 | fourth section |
| 20 | back plate |
| 22 | inlet |
| 24 | first metering slot |
| 26 | pump |
| 28 | carrier layer |
| 30 | inlet |
| 32 | second metering slot |
| 34 | pump |
| 36 | layer |
| 38 | inlet |
| 40 | third metering slot |
| 42 | pump |
| 44 | layer |
| 46 | inlet |
| 48 | fourth metering slot |
| 50 | pump |
| 52 | layer |
| 54 | first inclined slide surface |
| 56 | coating lip |
| 58 | second inclined slide surface |
| 60 | third inclined slide surface |
| 62 | fourth inclined slide surface |
| 64 | back land surface |
| 66 | coating backing roller |
| 70 | moving web |
| 72 | coating bead |

What is claimed is:

1. A method for controlling a level of adhesion between a support web and a coating applied thereto in a slide bead coating operation comprising the steps of:

(a) selecting the support web;

(b) selecting an organic solvent or blend of organic solvents that is substantially free of other constituents as a carrier layer;

(c) flowing a multilayer composite down a slide surface and over a coating lip of a coating hopper, the multilayer composite including the carrier layer;

(d) forming a coating bead between the coating lip and the web to thereby apply the multilayer composite to the support web;

(e) drying the multilayer composite on the support web, the carrier layer evaporating from the multilayer composite;

(f) testing an adhesive strength between the support web or subbing layer and the multilayer composite after drying; and (g) if a desired level of adhesion is not found in the testing step, selecting a different organic solvent or blend of organic solvents to modify the adhesive strength between the support web or subbing layer and the multilayer composite and repeating steps (c) through (g) until the desired level of adhesion is found.

2. A method as recited in claim 1 further comprising the step of:

determining whether to apply a subbing layer to the support web.

3. A method as recited in claim 2 further comprising the step of:

applying the subbing layer to the support web prior to the flowing step if so determined in the determining step.

4. A method as recited in claim 1 further comprising the step of:

applying a subbing layer to the support web prior to the flowing step.

5. A method for controlling a level of adhesion between a support web and a coating applied thereto in a slide bead, curtain, or extrusion hopper coating operation comprising the steps of (a) selecting the support web with or without a subbing layer applied thereto;

(b) selecting an organic solvent or a blend of organic solvents that is substantially free of other constituents as a carrier layer;

(c) forming a multilayer composite including the carrier layer, the carrier layer being the lowermost layer thereof;

(d) applying the multilayer composite to the support web or the subbing layer;

(e) drying the multilayer composite on the support web, the carrier layer evaporating from the multilayer composite;

(f) testing the adhesive strength between the support web or subbing layer and the multilayer composite after drying; and (g) if a desired level of adhesion is not found in the testing step, selecting a different organic solvent or blend of organic solvents and repeating steps (c) through (g) until the desired level of adhesion is found.

6. A method as recited in claim 5 further comprising the step of:

forming a coating bead with the multilayer composite to perform the applying step.

7. A method as recited in claim 5 wherein:

the carrier layer is comprised of a blend of organic solvents containing at least two of the following components: methanol, ethanol, isopropanol, n-butanol, acetone, methylethyl ketone, methylisobutyl ketone, toluene and methylene chloride.

8. A method as recited in claim 7 wherein:

the layers of the multilayer composite above the carrier layer contain at least one of the following polymeric materials: cellulosics, polyvinylbutyrals, polycarbonates, polyurethanes, and polyesters.

9. A method as recited in claim 8 wherein:

the layers of the multilayer composite above the carrier layer have a combined wet thickness in a range of 1–500 $\mu$m.

10. A method as recited in claim 9 wherein:

at least one layers of the multilayer composite above the carrier layer has a viscosity in the range of 10–5,000 cp.

11. A method as recited in claim 5 wherein:

the layers of the multilayer composite above the carrier layer contain at least one of the following polymeric materials: cellulosics, polyvinylbutyrals, polycarbonates, polyurethanes, and polyesters.

12. A method as recited in claim 5 wherein:

the layers of the multilayer composite above the carrier layer have a combined wet thickness in a range of 1–500 $\mu$m.

13. A method as recited in claim 5 wherein:

at least one layer of the multilayer composite above the carrier layer has a viscosity in the range of 10–5,000 cp.

14. A method as recited in claim 5 wherein:

at least one layer of the multilayer composite above the carrier layer includes water.

15. A method as recited in claim 5 wherein:

the moving web is untreated polyethylene terephthalate.

16. A method as recited in claim 5 wherein:

the moving web has a subbing layer.

17. A method as recited in claim 5 wherein:

the carrier layer has a surface tension of less than 40 dynes/cm.

18. A method as recited in claim 5 wherein:

the carrier layer has a wet thickness in the range of from about 1 to about 20 $\mu$m.

19. A method as recited in claim 5 wherein:

the carrier layer has a wet thickness of less than about 5 $\mu$m.

20. A method as recited in claim 5 wherein:

the moving web is untreated cellulose acetate.

21. A method as recited in claim 5 wherein:

the organic solvent is selected from the following group: methanol (0.6 cp.), acetone (0.3 cp.), methylethyl ketone (0.4 cp.), methyl isobutyl ketone (0.6 cp.), methylene chloride (0.4 cp.), toluene (0.6 cp.), methyl acetate (0.4 cp.), ethyl acetate (0.5 cp.), isopropyl acetate (0.5 cp.), n-propyl acetate (0.6 cp.), ethanol (1.2 cp.), n-propanol (2.3 cp.) and n-butanol (3.0 cp.).

22. A method as recited in claim 21 wherein:

the layers of the multilayer composite above the carrier layer contain at least one of the following polymeric materials: cellulosics, polyvinylbutyrals, polycarbonates, polyurethanes, and polyesters.

23. A method as recited in claim 22 wherein:

the layers of the multilayer composite above the carrier layer have a combined wet thickness in a range of 1–500 $\mu$m.

24. A method as recited in claim 23 wherein:

at least one layers of the multilayer composite above the carrier layer has a viscosity in the range of 10–5,000 cp.

* * * * *